United States Patent [19]

Bischlipp et al.

[11] 4,185,439

[45] Jan. 29, 1980

[54] CONNECTING ELEMENT AND A METHOD OF MANUFACTURE THE SAME

[75] Inventors: Klaus Bischlipp, Hasslinghausen; Werner Weitzel; Walter Hueck, both of Luedenscheid, all of Fed. Rep. of Germany

[73] Assignee: Eduard Hueck, Luedenscheid, Fed. Rep. of Germany

[21] Appl. No.: 899,789

[22] Filed: Apr. 25, 1978

[30] Foreign Application Priority Data

May 12, 1977 [DE] Fed. Rep. of Germany ..... 2721367
Aug. 11, 1977 [DE] Fed. Rep. of Germany ..... 2736151

[51] Int. Cl.[2] ..... E04B 1/62; E04C 3/29

[52] U.S. Cl. ..... 52/731; 29/155 R; 29/418; 49/DIG. 1; 52/98; 52/403; 264/46.5; 264/261

[58] Field of Search ..... 52/732, 731, 730, 729, 52/403, 98, 99; 49/DIG. 1; 29/155 R, 418; 264/261, 46.5

[56] References Cited

U.S. PATENT DOCUMENTS

| | | | |
|---|---|---|---|
| 3,393,487 | 7/1968 | Nolan | 52/403 |
| 3,798,869 | 3/1974 | Nipp | 52/731 X |
| 3,815,216 | 6/1974 | Brockway et al. | 52/403 X |
| 3,823,524 | 7/1974 | Weinstein | 49/DIG. 1 |
| 3,992,769 | 11/1976 | Jackson | 52/403 X |

FOREIGN PATENT DOCUMENTS

| | | | |
|---|---|---|---|
| 672740 | 3/1966 | Belgium | 49/DIG. 1 |
| 1245567 | 7/1967 | Fed. Rep. of Germany | 52/732 |
| 2129964 | 2/1972 | Fed. Rep. of Germany | 52/732 |
| 2531221 | 2/1977 | Fed. Rep. of Germany | 49/DIG. 1 |

*Primary Examiner*—Alfred C. Perham
*Attorney, Agent, or Firm*—Michael J. Striker

[57] ABSTRACT

A connecting element, particularly for windows, doors and the like, has two elongated profiled elements spaced from one another in a first direction transverse to the direction of elongation thereof so as to bound with one another a channel, and two heat insulating inserts located in the channel, which inserts extend in the first direction between the profiled elements and are spaced from one another in a second direction transverse to the first direction so as to provide an intermediate hollow space between the inserts. A method of manufacturing the connecting element includes the steps of providing the two elongated profiled elements which bound with one another the channel, supplying into the channel a hardenable heat insulating material so as to fill two sections of the channel which are spaced from one another whereby an intermediate hollow space is provided between the sections, and hardening the heat insulating material in these sections of the channel, so that the hardened material forms the above-mentioned two heat insulating inserts which are connected with the profiled elements and spaced from one another.

33 Claims, 15 Drawing Figures

CONNECTING ELEMENT AND A METHOD OF MANUFACTURE THE SAME

BACKGROUND OF THE INVENTION

The present invention relates to a connecting element, particularly for windows, doors and the like, and a method of manufacturing the same.

Methods of manufacturing a connecting element have been proposed in the art, in accordance with which two elongated profiled elements are provided spaced from one another in a first direction transverse to the direction of elongation thereof so as to bound with one another a channel which is open at at least one side thereof, supplying into the channel a hardenable heat insulating material so as to fill the same, and hardening the heat insulating material in this channel. The thusmanufactured connecting element includes two elongated profiled elements and an insulating insert which connects the profiled elements with one another.

One of such methods is disclosed in the German Auslegeschrift No. 1,245,567. In accordance with this method an integral member is provided, which includes two such elongated profiled elements connected with one another by a connecting portion which forms a bottom of this integral member. A heat insulating sealing material is supplied into a channel formed between the profiled elements and the connecting portion, and after the material is hardened, the connecting portion is mechanically removed, for instance by milling, so that the metallic profiled elements are no longer connected by metallic means.

In accordance with a method disclosed in the German Offenlegungsschrift No. 2,129,964, two separate elongated metallic profiled elements are provided which are positioned relative to one another so as to bound the above-mentioned channel, and an additional bottom member is provided so as to bound this channel from below. The channel which is bounded by the separate metallic profiled elements and the bottom member is thereupon filled by the heat insulating material, and after hardening of the latter the bottom member is removed. It is understood that the bottom member serves for bounding the channel and supporting the heat insulating material supplied therein.

It has been known from the practice to provide holding means in the metallic profiled elements, such as projections or undercuts, and to provide projections on outer edges of the above-mentioned bottom member so that the latter can be inserted or clamped in the holding means before supplying the heat insulating material into the channel. An advantage of such a method is that the bottom or supporting member which is constituted by a material having low heat conduction characteristics can remain between the metallic profiled elements after hardening of the insulating material, inasmuch as heat insulating properties of this member do not undesirably affect heat insulation between the metallic profiled elements.

In all the above-discussed methods, the heat insulating material completely fills the channel which is bound between the metallic profiled elements. Measurements which have been performed for estimating the heat transmission between the metallic profiled elements of the connecting element manufactured in accordance with the above-mentioned methods, have shown that the attained magnitude of heat conduction has not always corresponded to the required standards. For these reasons, up to now from a great number of materials only some insulating materials could be utilized which satisfy both the requirements made with respect to their heat insulating characteristics, and the requirements made with respect to their strength. Thus, the selection of an insulating material for such connecting elements had to be made on a compromise. For instance, a material which is extremely inexpensive, has outstanding strength, has good filling properties and short hardening time, cannot be used until it has such heat conduction characteristics that when the connecting element is manufactured the heat insulating insert produced by such a material will satisfy the required standards.

SUMMARY OF THE INVENTION

Accordingly, it is an object of the present invention to provide a connecting element, particularly for windows or doors, and the like, and a method of manufacturing the same which avoid the disadvantages of the prior art.

More particularly, it is an object of the present inventin to provide a connecting element and a method of manufacturing the same, in accordance with which the connecting element is simply and inexpensively manufactured, and at the same time the heat transmission between metallic profiled elements of the connecting element through a heat insulating insert located therebetween is reduced.

Another object of the present invention is to provide a connecting element and a method of manufacturing the same, which permit a wider range of heat insulating materials to be utilized in the connecting element, as compared with the known connecting elements and methods of manufacturing the same.

In keeping with these objects and with others which will become apparent hereinafter, one feature of the present invention resides, briefly stated, in a method of manufacturing a connecting element which includes the steps of providing two elongated profiled elements spaced from one another in a first direction transverse to the direction of elongation thereof so as to bound with one another a channel, supplying into the channel a hardenable heat insulating material so as to fill the sections of the channel which are spaced from one another in a second direction transverse to the first direction, whereby an intermediate hollow space is provided between the sections, and hardening the heat insulating material in the sections of the channel, for the hardened material to form two heat insulating inserts which are connected with the profiled element and are spaced from one another by the intermediate hollow space. The thus-manufactured connecting element includes the two elongated profiled elements which are connected with one another by the two heat insulating inserts, which later are spaced from one another by the intermediate hollow space. When the above-described method is utilized and the above-mentioned connecting element is manufactured, heat transfer between the metallic profiled elements through the heat insulating material located in the channel is substantially reduced and thereby the connecting element has increased heat insulating properties. At the same time the range of heat insulating materials which can be utilized for manufacturing the connecting element is substantially increased.

It is to be understood that one end of the channel may be open, whereas another end thereof, as considered in the second direction, may be closed, by a connecting portion which can be removed after hardening the insulating material in the channel. The heat insulating material may be supplied in a flowable state or in an approximately flowable state. Engaging means may be provided on inner surfaces of the profiled elements so as to engage the heat insulating inserts, which engaging means may be formed as projections or undercuts.

Another feature of the method in accordance with the present invention is that the heat insulating material may be supplied in one of the sections of the channel, a separating member may be inserted in the channel so as to bound the intermediate hollow space and to separate the latter from another of the sections, and thereafter the heat insulating material may be supplied into the thus-separated other section of the channel. The above-mentioned other section of the channel may be located above the one section thereof, and the separating member may be located below the other section.

Still another feature of the method of the present invention is that the heat insulating material may be supplied into the channel so as to fill a third section of the latter, which third section is spaced from one of the two sections in a second direction whereby a further hollow intermediate space is formed between the second section and the one section of the channel. Therefore, a third such heat insulating insert is formed between the metallic profiled elements.

A further feature of the method in accordance with the method of the present invention is that the two metallic profiled elements are formed as an integral member including a connecting strip which connects the profiled elements with one another and bounds the sections of the channel at one side thereof. The connecting strip is removed after hardening the heat insulating material in the one section of the channel. The one section may be located below the other section of the channel, and the connecting strip may be located so as to bound the one section from below.

In order to manufacture a connecting element having great dimensions and a closed channel provided between the metallic profiled elements, the connecting elements may be formed as an integral member having two connecting strips which are spaced from one another in the second direction and connects the profiled elements as well as outwardly bounds the sections of the channel. In this case, the connecting element having great dimensions may be manufactured with great tolerance accuracy. One of the connecting strips bounds the channel from below, whereas another connecting strip bounds the channel from above and can be removed before supplying of the heat insulating material into the channel.

In the method in accordance with the present invention, the separating member preferably may be formed by a foil sheet, or by a rigid or flexible strip which is fixed to the metallic profiled elements by holding means provided in the latter. The separate member may be removed from the holding means after hardening of the heat insulating material in the channel. When the separating member is constituted by a material having low heat conductive characteristics, it preferably may remain in the connecting element as a relinquished part.

A still further feature of the method in accordance with the present invention is that the separating member can completely full the channel provided between the metallic profiled elements. The thus-formed separating member may be constituted by a material having heat transmission properties which are lower as compared with those of the heat insulating inserts. Preferably, such separating member may be constituted by a suitable sponge rubber material.

An additional feature of the method in accordance with the present invention is that in order to further increase heat insulating characteristics of the connecting element holes may be formed in the heat insulating inserts. Preferably, such holes may be milled out or sewn out.

The holes may be formed in one or in several heat insulating inserts.

In accordance with another feature of the connecting element of the present invention, a separating member can be provided which separates the intermediate hollow space from one of the sections accommodating one of the heat insulating inserts. Inasmuch as the intermediate hollow space is bounded only at one of its sides by the one separating member, the material expenditures for additional means for manufacturing the connecting element are minimum.

In order to facilitate mounting of the separating member, holding elements may be provided on inner surfaces of the metallic profiled elements and operative for fixing the separating member to the latter.

In accordance with a further feature of the connecting element of the present invention, one of the heat insulating inserts is located above another heat insulating insert, and therefore the height of the intermediate hollow space is defined between a lower surface of the upper insert and an upper surface of the lower insert, whereas the width of the hollow intermediate space is defined between the inner surfaces of the metallic profiled elements. When the separating member is located below the upper insert, the height of the intermediate hollow space is defined between a lower surface of the separating member and the upper surface of the lower insert. In this case things which fall through the intermediate hollow space are held on the heat insulating material as little as possible.

In accordance with an additional feature of the connecting element of the present invention, a separating element may completely fill the intermediate hollow space. Such separating element may be constituted by a foam rubber material whose heat conduction properties are lower as compared with those of the heat insulating inserts. In spite of the fact that the connecting element completely fills the intermediate hollow space, it can remain in the finished connecting element inasmuch as it is not subjected by any force.

In accordance with an additional feature of the connecting element of the present invention, the heat insulating inserts may have holes which are spaced from one another in the direction of elongation of the inserts. The holes are preferably milled. The holes may be provided either in one insulating insert or in several inserts located one above another.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 5:
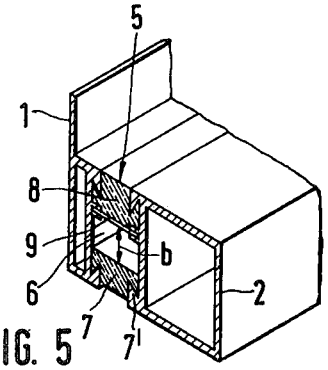
Figure 15:
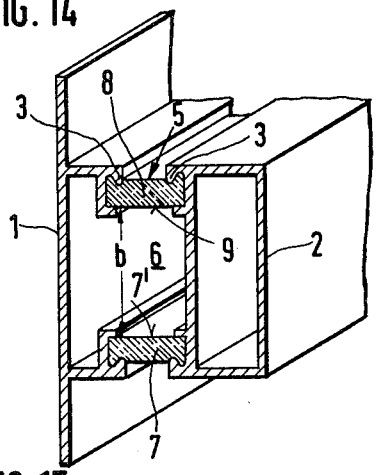

A connecting element, particularly for windows, doors and the like, is shown in FIGS. 5 and 15 and has two metallic profiled elements 1 and 2 which are located at a distance from one another. Each of the metallic profiled elements 1 and 2 has engaging means, such as projections, undercuts and the like 3 and 4 which engage an insulating element 5 located in a channel formed between the metallic profiled elements 1 and 2. Thereby, the heat insulating element 5 is firmly connected with the metallic profiled elements 1 and 2. An intermediate hollow space 6 is provided substantially in a central region of the heat insulating element 5 and extends in a direction of elongation of the profiled elements so as to separate the element 5 into two parallel heat insulating inserts 7 and 8. The intermediate hollow space 6 is throughgoing and open at its both ends, as considered in the direction of elongation thereof. It is to be understood that the heat insulating inserts 7 and 8 may be inclined relative to one another or may be only approximately parallel to one another.

Figure 3:
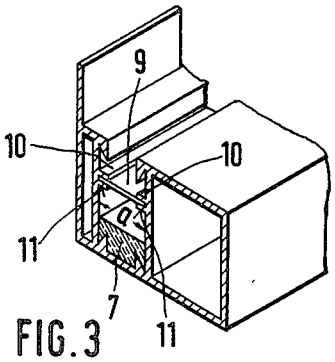

The intermediate hollow space 6 is bounded at its upper side by a rigid or flexible separating member 9. The separating member 9 is constituted by a material which possesses low heat conduction properties and remains in the finished connecting element as a relinguished part. Projections 10 and 11 extend from inner surfaces of the metallic profiled elements 1 and 2 inwardly of the channel formed between the latter. The projections 10 and 11 also extend in the direction of elongation of the profiled elements 1 and 2 and bound with one another a groove 12 shown in FIG. 3. The separating member 9 is inserted in the groove 12. The height of the intermediate hollow space 6 corresponds to a distance b between an upper surface 7' of the lower heat insulating inserts 7 and a lower surface of the separating member 9. The width a is defined by a distance between the inner surfaces of the metallic profiled elements 1 and 2.

Figure 13:
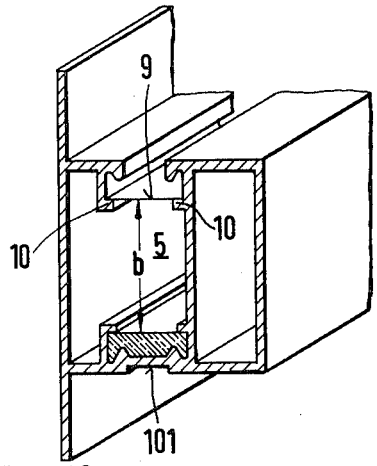
Figure 14:
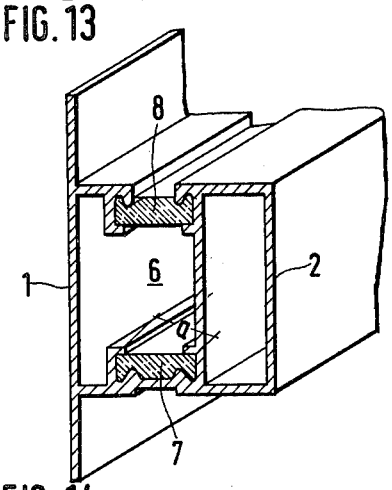

It is also possible, instead the pair of projections 10 and 11 forming the groove 12, to provide holding means which differs from the above-mentioned holding means and shown in FIGS. 13–15. For instance, the separating member 9 can be inserted from above between the metallic profiled elements or can be subsequently removed if necessary. The separating member 9 may be also constituted by a self-sticking foil sheet which can be subsequently pulled out.

The connecting element may be manufactured from differently constructed initial profiles. In accordance with FIG. 1, an initial profile may be formed as an integral member which can be subsequently separated into two profiled elements 1 and 2. The initial connection between the profiled elements 1 and 2 is performed by a connecting portion 13 which forms a bottom of the initial profile and together with the metallic profiled elements 1 and 2 bounds a trough-shaped channel 14. The channel 14 is open from above, and the heat insulating insert 7 is located in a lower section of the channel, whereas the upper heat insulating insert 8 is located in an upper section of the channel separated from the intermediate hollow space 6 by the separating member 9.

Figure 10:
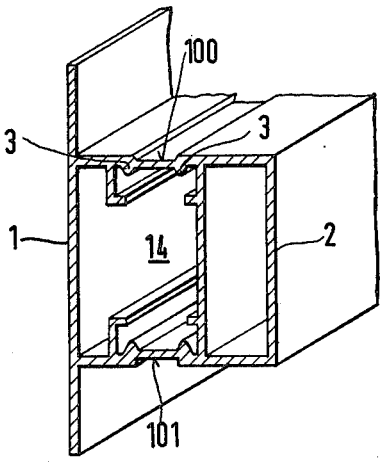
FIGS. 10 to 15 are views showing several steps of a process of manufacturing a connecting element in accordance with the present invention, wherein the connecting element is manufactured from an initial profile differing from the profile shown in FIG. 1.
Figure 11:
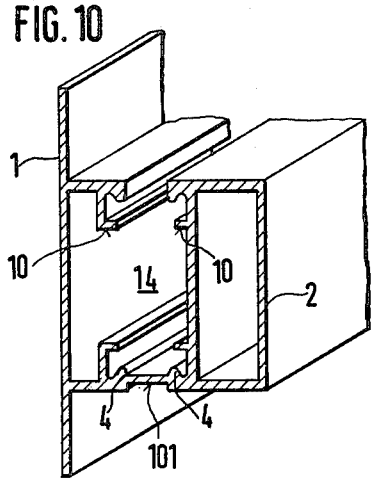

An initial profile shown in FIG. 10 is also formed as an integral member which is subsequently separated into two profiled elements 1 and 2. The initial connection between the profile elements 1 and 2 is performed by two connecting portions 100 and 101. The connecting portion 101 forms a bottom of the profiled elements 1 and 2, whereas the connecting portion 100 connects the profiled elements 1 and 2 in upper regions thereof. The channel 14 is formed between the profiles 1 and 2 and the connecting portions 100 and 101. Before supplying a heat insulating material into the channel 14, the connecting portion 100 is removed so that the channel 14 assumes the shape of an upwardly open channel shown in FIG. 11. The lower heat insulating insert 7 is located in a lower section of the thus-formed channel 14, whereas the upper heat insulating insert 8 is located in an upper section of the channel 14 separated from the intermediate hollow space 6 by the separating member 9 (FIG. 13). Additional subdivisions may also be formed in this profile.

Figure 9:
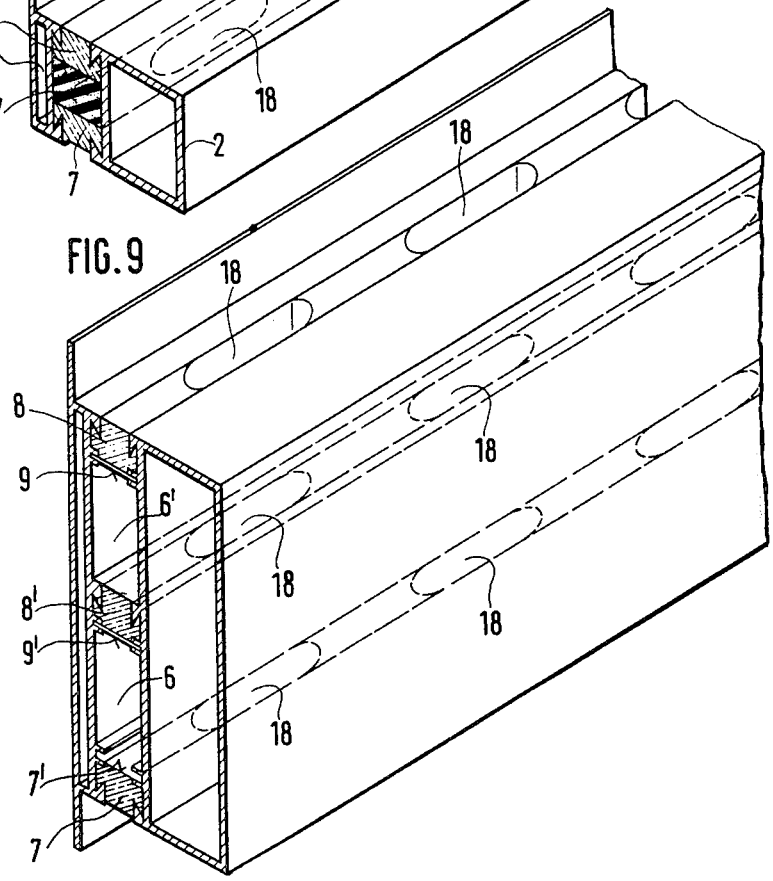
FIG. 9 is a view showing a connecting element including two metallic profiled elements and three heat insulating inserts located therebetween.

As shown in FIG. 9, two such separating members 9 and 9' and two such intermediate spaces 6 and 6' may be provided, so that the heat insulating element 5 includes three heat insulating inserts 7, 8 and 8'. It has to be evident that further subdivisions may be provided, especially in the cases when the connecting element has an extremely great dimensions and the channel between the profiled elements 1 and 2 is extremely big.

Figure 6:
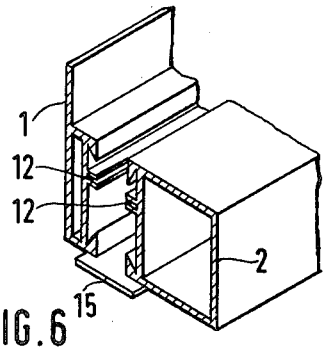
FIG. 6 is a view showing an initial profile according to another embodiment of the invention.
Figure 7:
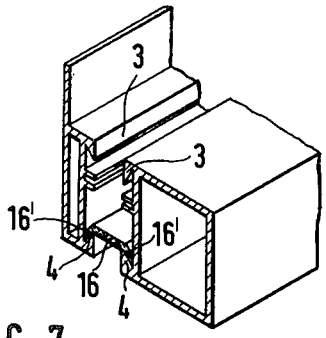
FIG. 7 is a view showing an initial profile in accordance with a further embodiment of the invention.

As shown in FIGS. 6, 7 and 9 the metallic profiled elements 1 and 2 may be initially separated from one another. At the same time, an additional cover element 15 may be provided, as shown in FIG. 6 which has functions substantially corresponding to the functions of the connecting portions 13 and 101 shown in FIGS. 1 and 10, respectively. Cover element 15 is a bottom part of the connecting element and is a part of a not shown mold in which both profiled elements 1 and 2 are inserted for supplying the heat insulating material therebetween.

As shown in FIG. 7, instead of providing a cover element 15, the distance between the metallic profiled elements 1 and 2 can be bridged by a strip 16 shown in FIG. 7 and constituted by a material which has low heat conduction properties. The strip 16 may remain in the finished connecting element as a relinquished part. For this purpose, the strip 16 engages with its edge 16' in the projection or undercut 3 and 4 so as to form a connection between the metallic profiled elements.

Figure 1:
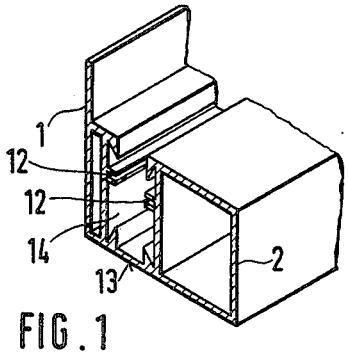
FIGS. 1 to 5 are views showing several steps of a method of manufacturing a connecting element in accordance with the present invention, wherein the connecting element is manufactured from an initial profile corresponding to one embodiment of the invention.
Figure 2:
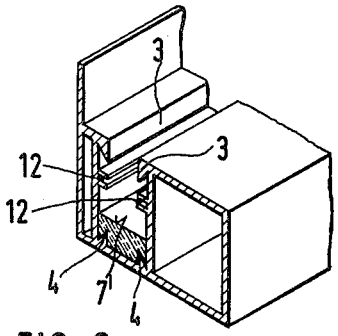
Figure 4:
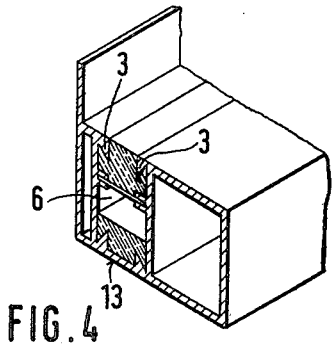
Figure 12:
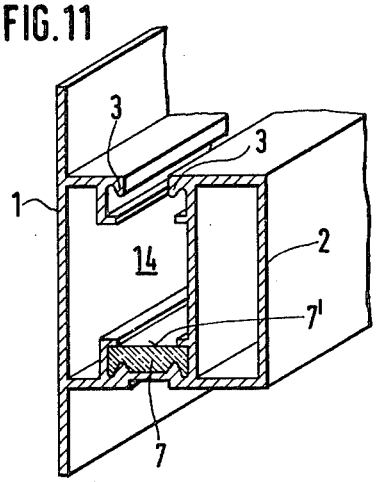

The method of manufacturing the connecting element in accordance with the present invention from the initial profiles shown in FIGS. 1 and 10 includes the following steps:

The channel 14 must be opened in order to provide for a possibility to supply a heat insulating material into the same. Whereas in the profile shown in FIG. 1 the channel 14 is already open, in the profile shown in FIG. 10, the channel 14 must be opened by removing the connecting portion 100. The heat insulating material is supplied in flowable state into the channel 14 so that it fills the latter up to the surface identified by reference numeral 7' in FIGS. 2 or 12. Without waiting until the material is hardened, the separating member 9 is inserted from one side of the metallic profiled elements at a distance b above the level of the material 7' into the groove between the projections 10 and 11 (FIG. 3), or from above (FIG. 13), so as to bound the intermediate hollow space 6 from above. The separating member 9 forms an upper section of the channel 14 which is filled with the heat insulating material as shown in FIGS. 4 or 14. Immediately after hardening of the heat insulating material in the lower section the lower connecting portions 13 or 101 between the metallic profiled elements 1 and 2 is mechanically removed. The connecting element is ready for further working.

The supply of the heat insulating material into the lower section of the channel 14 and into the upper section thereof, as well as the removal of the connecting portions 13 or 101 may be performed in one continuous process. It is always necessary to fill the lower section of the channel 14 prior to insertion of the separating member 9 so that immediately after this the heat insulating material may be supplied into the thus-bounded upper section of the channel 14. Prior to the removal of the connecting portions 13 and 101 it is necessary to wait until the material admitted into the lower section of the channel 14 is hardened, that in practice is performed in some seconds.

The above-described method is acceptable for manufacturing the connecting element from the initial profiles shown in FIGS. 6, 7 and 9, with only one difference that the cover member 15 must be separated from the metallic profiled elements 1 and 2 only then, when the heat insulating material is hardened in at least the lower section of the channel 14. A removal of the element 16 in accordance with the embodiment shown in FIG. 7 is not needed.

Figure 8:
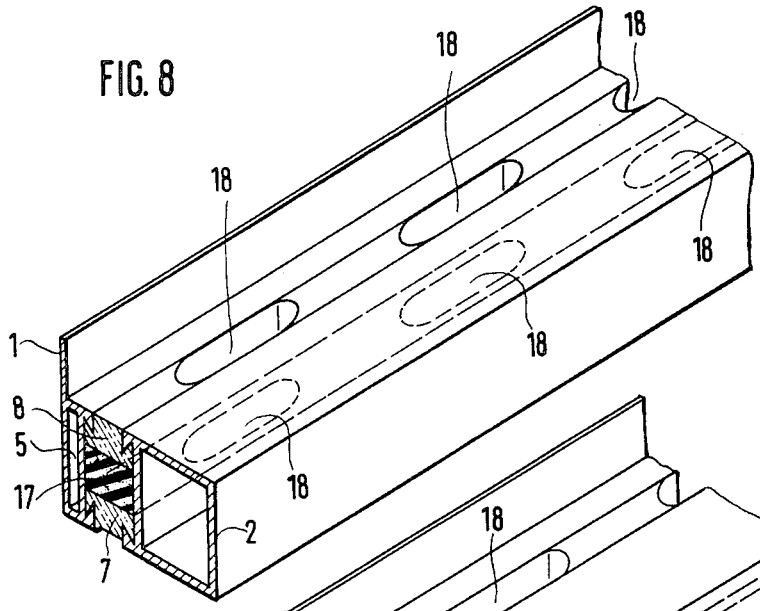
FIG. 8 is a view showing a connecting element which includes metallic profiled elements, heat insulating inserts located therebetween and provided with holes, and a separating element located between the heat insulating inserts.

In accordance with the embodiment shown in FIG. 8, instead of utilizing the separating members 9 and 91, an element 17 is located between the metallic profiles 1 and 2 and completely fills the intermediate hollow space between the heat insulating inserts 7 and 8. The element 17 may be constituted by a sponge rubber material. This material has heat transmission properties which are lower than those of the material of the heat insulating inserts 7 and 8 and therefore can remain in the finished connecting element, in spite of the fact that it fills the intermediate hollow space. It is to be understood that other suitable materials can be utilized for the element 17. In order to reduce the contact surfaces and to thereby reduce the heat transmission between the metallic profiled elements 1 and 2, the heat insulating insert in all the described examples can be additionally provided with holes 18. These holes may be made by milling, sewing and the like. Even though in the examples shown in FIGS. 8 and 9, the holes 18 are provided in all heat insulating inserts located one above another, it is to be understood that only some of the heat insulating inserts may have the holes 18. The holes 18 may be made continuously with performance of other steps of the method, for instance simultaneously with the removal of the connecting portions 13 or 101.

It will be understood that each of the elements described above, or two or more together, may also find a useful application in other types of constructions differing from the types described above.

While the invention has been illustrated and described as embodied in a connecting element particularly for windows, doors and the like, and a method of manufacturing the same, it is not intended to be limited to the details shown since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method of manufacturing a connecting element, particularly for windows, door and the like, comprising the steps of providing two elongated profiled elements; positioning said elongated profiled elements so that they are laterally spaced from one another and bound with one another an elongated channel having an upper section and a lower section which are spaced from each other in an upright direction; supplying a hardenable heat insulating material into at least a portion of the length of said lower section of said channel; thereafter inserting a transverse member extending over at least said portion between said elongated profiled elements only at a lowermost location of said upper section and at a distance from said lower section so as to bound a hollow intermediate space therebetween and to separate said upper section from said intermediate space, and fixing said transverse member to said elongated profiled elements; supplying the hardenable heat insulating material into the thus-separated upper section of said channel so as to fill said upper section; and hardening the hardenable heat insulating material in said upper and lower sections of said channel so as to form two heat insulating inserts which connect said elongated profiled elements with each other and are spaced from one another in the upright direction by said intermediate space.

2. The method as defined in claim 1, wherein said providing step includes forming on said profiled elements means adapted to engage said insulating inserts, and arranged on surfaces of said profiled elements which face toward one another.

3. The method as defined in claim 2, wherein said forming step includes forming a projection.

4. The method as defined in claim 2, wherein said forming step includes forming an undercut.

5. The method as defined in claim 1, wherein said supplying step includes supplying said heat insulating material in an at least approximately flowable state.

6. The method as defined in claim 1, wherein said supplying step includes supplying said heat insulating material into said channel so that said sections of the latter are substantially parallel to one another.

7. The method as defined in claim 1; and further comprising supplying said hardenable heat insulating material into said channel so as to also fill a third section thereof, which is spaced from one of said two sections in said upright direction, whereby a further hollow intermediate space is formed between said third section and said one section, and hardening of said heat insulating material in said third section of said channel, for the hardened material to form a third such heat insulating insert.

8. The method as defined in claim 1, wherein said providing step includes providing such profile elements which are initially connected with one another by a connecting strip bounding said lower section at an outer side thereof, and together with said profile elements forming an integral member; and further including the step of removing said connecting strip after hardening said heat insulating material in said lower section.

9. The method as defined in claim 1, wherein said providing step includes providing such profile elements which are connected with one another by two connecting strips, so as to form an integral member, said connecting strips being spaced from one another in said second direction and each outwardly bounding a respective one of said sections of said channel; and further comprising the step of retaining the connecting strip bounding said lower section and removing the connecting strip bounding said upper section so as to open the latter prior to supplying said heat insulating material into said lower section.

10. The method as defined in claim 1, wherein said inserting step includes utilizing a foil sheet as said transverse member.

11. The method as defined in claim 1, wherein said inserting step includes utilizing a rigid strip as said transverse member.

12. The method as defined in claim 1, wherein said inserting step includes utilizing a flexible strip as said transverse member.

13. The method as defined in claim 1, wherein said providing step includes providing holding means on said profiled elements, said fixing step includes fixing said transverse member relative to said profiled elements by said holding means.

14. The method as defined in claim 1, wherein said transverse member remains after said hardening step as a relinguished part of the connecting element.

15. The method as defined in claim 1, wherein said inserts are elongated and extend in the direction of elongation of said profiled elements; and further comprising the step of making at least one throughgoing hole in one of said inserts, which hole extends in a direction transverse to the direction of elongation of said one insert.

16. The method as defined in claim 15, wherein said making step includes milling out said hole.

17. The method as defined in claim 15, wherein said making step includes sawing out said hole.

18. The method as defined in claim 15, wherein said making step includes making at least one further hole in said one inserts, which are spaced from said first-mentioned hole in the direction of elongation of said one insert.

19. The method as defined in claim 15, wherein said inserts are located one above another, said making step includes making such hole in another of said heat insulating inserts.

20. The method as defined in claim 1, wherein said hardenable heat insulating material substantially does not expand during hardening.

21. A connecting element, particularly for windows, doors and the like, comprising two elongated profiled elements laterally spaced from one another so as to bound with one another a channel having an upper section and a lower section which are spaced from each other in an upright direction; two heat insulating inserts produced by filling said sections of said channel with a hardenable heat insulating material and located in said sections so that said inserts connect said elongated profiled elements with each other and, at the same time, are spaced from one another in the upright direction by an intermediate space which remains therebetween; only one transverse member extending between and fixed to said elongated profiled elements only at a lowermost location of said upper section and at a distance from said lower section so that said transverse member both separates said upper section of said channel from said intermediate space whereby the height of said intermediate space in the upright direction is defined between a lower surface of said transverse member and an upper surface of said lower insert, and reinforces said connecting element in a lateral direction at said location; and means for fixing said transverse member to said elongated profiled elements.

22. The connecting element as defined in claim 21, wherein said profiled elements are provided with means for engaging said heat insulating inserts.

23. The connecting element as defined in claim 22, wherein said profiled elements have inner surfaces facing toward one another, said engaging means being provided on said inner surfaces.

24. The connecting element as defined in claim 22, wherein said engaging means includes a projection.

25. The connecting element as defined in claim 22 wherein said engaging means includes an undercut.

26. The connecting element as defined in claim 21, wherein said channel has upper and lower ends spaced from one another in said upright direction, said upper end of said channel being open whereas said lower end is closed.

27. The connecting element as defined in claim 26; and further comprising a connecting member which is located below said lower section of said channel and closes said lower end of the latter, said connecting member connecting said elongated profiled elements with each other only from below, whereas said elongated profiled elements are not connected with each other from above.

28. The connecting element as defined in claim 21, wherein said heat insulating inserts are substantially parallel to one another.

29. The connecting element as defined in claim 21, wherein said inserts are elongated in the direction of elongation of said profiled elements, at least one of said inserts having a throughgoing hole extending in a direction transverse to the direction of elongation thereof.

30. The connecting element as defined in claim 29, wherein said one insert has at least one further hole spaced from said first mentioned hole in the direction of elongation of said insert.

31. The connecting element as defined in claim 29, wherein another of said inserts has at least one such hole.

32. The connecting element as defined in claim 29, wherein said hole is a milled hole.

33. The connecting element as defined in claim 21; and further comprising a third such insert which is spaced from one of said two inserts in said upright direction so as to provide a further intermediate space between said third insert and said one insert.

* * * * *